United States Patent [19]

Kawanobe et al.

[11] Patent Number: 4,619,694

[45] Date of Patent: Oct. 28, 1986

[54] METHOD OF REFINING STEEL AND APPARATUS

[75] Inventors: Yasutaka Kawanobe; Hisao Noguti, both of Gunma; Singi Kanou, Shinto; Katsuya Yamazaki, Aichi, all of Japan

[73] Assignees: Daido Tokusyuko K.K., Nagoya; Yahagi Engineering K.K., Aichi, both of Japan

[21] Appl. No.: 520,727

[22] Filed: Aug. 5, 1983

[30] Foreign Application Priority Data

Aug. 5, 1982 [JP] Japan ..... 57-136532

[51] Int. Cl.[4] ..... C21C 5/30

[52] U.S. Cl. ..... 75/59.14; 75/59.15

[58] Field of Search ..... 75/60, 59, 59.14, 59.15

[56] References Cited

U.S. PATENT DOCUMENTS 3,720,404 3/1973 Carlson ..... 75/60

*Primary Examiner*—Peter D. Rosenberg

*Attorney, Agent, or Firm*—Armstrong, Nikaido, Marmelstein & Kubovcik

[57] ABSTRACT

In refining of a steel, the amount of heat taken away in a unit time by the exhaust gas leaving the refining vessel is observed, and, in response to change of the amount of heat, ratios of refining gases blown into the vessel are controlled so that oxidation loss of the metals may decrease, that temperature of the molten steel may be easily controlled, and that carbon content in the molten steel may be determined with decreased number of chemical analysis.

10 Claims, 8 Drawing Figures

C

METHOD OF REFINING STEEL AND APPARATUS

BACKGROUND OF THE INVENTION

1. Field of Invention

The present invention concerns an inprovement in the method of refining, particularly decarburization of molten steel. The invention also concerns an apparatus for carrying out this method of refining.

The term "molten steel" in this specification means, not only metal mixtures having composition of steel at the initial stage of melting, but also those which may have a composition of steel as the result of the refining, such as pig iron.

2. State of the Art

In the processes for refining by blowing oxygen gas into the molten steel in an vessel such as a conventor, AOD furnace and VOD furnace, to cause decarburization and other refing reactions, it is essential to accurately determine the carbon content in the molten steel and to lead the final carbon content to a desired level. Also, in the processes for refining using an inert gas such as argon gas in addition to oxygen gas, with the view to reduce manufacturing costs, it is quite preferable to choose the most suitable flow rates and mixing ratios of the gases on the basis of the carbon content in the molten steel at various stages of the decarburization. If the expected optimum operation could be carried out to shorten the necessary period of the refining, it would be possible to increase time of using the vessel which is at present limited by the life of refractories.

As a matter of fact, it is not easy to determine the optimum pattern of the operation. The only way now available to find out a better operation pattern relies upon experiences resulted from trial-and-error. For example, in the refining of a stainless steel by AOD process, blowing gasses is interrupted at the first, the second and the third stages of the decarburization period when the carbon content of the molten steel reaches 0.30%, 0.10 % and the target level, respectively, the flow rates of oxygen gas and the inert gas (therefore, also the mixed ratio thereof) is changed prior to proceeding the subsequent stage, and, after completion of the decarburization period, chromium-reducing period comes.

The operation pattern as described above should be determined in each case on the basis of the composition of the steel to be refined. However, no effective way of deciding the operation pattern has been found. Furthermore, it has been necessary to take samples of the molten steel for chemical analysis at every stages and to measure the temperature. It is of course preferable to decrease the necessity of sampling and temperature measurement, and save time and labor.

Under the circumstances, there has been demand for the way of determining the carbon content in the molten steel, which is decreasing due to the decarburization, with decreased number of chemical analysis, and of improving rate of getting right carbon content as desired.

As a method of assuming the carbon content in the molten steel during a steelmaking process with decarburization, there was disclosed the technology to measure contents of CO and $CO_2$ in the exhaust gas from the refining vessel by chemical analysis to calculate the total amount of carbon deprived of the molten steel on the basis of the total volume of the exhaust gas, thereby to determine the amount of remaining carbon (Japanese Patent Disclosure No. 54-42323). Also, it was proposed to recognize the pattern of decarburization rate based on the chemical analysis of the exhaust gas to improve the rate of getting the right final carbon content (Japanee Patent Disclosure No. 54-53612).

It is a prerequisite for use calculation of the amount of the removed carbon based on the chemical analysis of the exhaust gas that not only the composition but also the flow rate of the exhaust gas is acculately measured. This is, however, not easy in general, and particularly difficult in applying to the refining in which an open type refining vessel is used.

DRAWINGS

SUMMARY OF THE INVENTION

Figure 1:
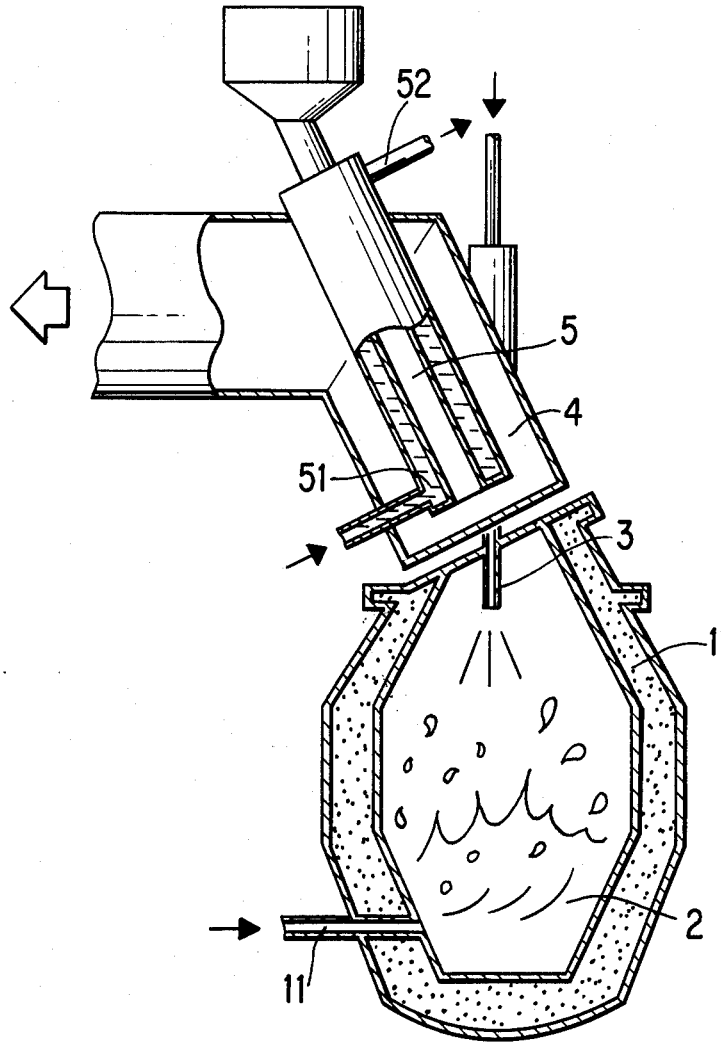
FIG. 1 shows main parts of the apparatus to illustrate typical embodiment of the method of refining steel according to the present invention.

An important object of the present invention is to provide an improved method of refining steel with decarburization in which the carbon content in the molten steel is acculately assumed without chemical analysis of the exhaust gas, thereby to eliminate the necessity of sampling and analysis. Another object of the present invention is to provide an improved method of refining steel in which temperature increase of the molten steel is assumed without direct measurement, thereby to avoid abnormal temperature increase of the molten steel and perform the refining.

An object of the present invention in a specific embodiment is to provide an improved method of decarburizing refining in which oxygen gas and an inert gas are blown into the molten steel containing chromium, comprising controlling the flow rates and mixing ratio of the gases depending upon the proceeding of the decarburization, thereby to avoid unnecessary oxidation of chromium and decrease loss chromium.

A further object of the present invention is to provide a method of the above described refining process practiced under automatic controll.

Still further object of the present invention is to provide an apparatus suitable for practicing the above noted refining method.

Change of decarburization rate in refining steel on lape of time follows the pattern known to those skilled in the art as "trapezoid model". At the initial stage of decarburization, the carburization rate increases as Si-content decreases and temperature increases, at the middle stage, the rate remains constant (reaction rate-determining), and at the final stage, the rate linearly decreases in proportion to the carbon content (diffusion rate-determining). The carbon content at the point of proceeding from the middle stage to the final stage is considered to be about 0.3%.

We noted the fact that, when decarburization rate decreases, the amount of heat generated by combustion of carbon decreases, and assumed that this change will reflect on the amount of heat taken away by the exhaust gas leaving the refining vessel. Our assumption was affirmed by experiments.

The present method of refining steel is basically characterized in that, in the refining steel in which decarburizing is performed by blowing oxygen into the molten steel in the refining vessel, the carbon content in the molten steel is determined by measuring the change of the amount of heat taken away in an unit time by the exhaust gas leaving the refining vessel.

PREFERRED EMBODIMENTS OF THE INVENTION

Determination of the amount of heat taken away by the exhaust gas leaving the refining vessel may be achieved by measuring temperature and flow rate of the exhaust gas. Measurement of the flow rate, however, includes the same problem as mentioned about the known method utilizing the analysis of chemical composition of the exhaust gas. According to our experience, it is possible to determine the amount of heat taken by the exhaust gas in a unit time by observing change of heat load of cooling water for accessories installed in the passageway of the exhaust gas. Though this method seems to be indirect and ineffective, it was found to be accurate and practical.

A typical accessory installed in the passageway of the exhaust gas is the shooter through which alloying elements are added to the molten steel during refining. The heat load of the cooling water may be readily determined by observing difference between the temperatures at the inlet and outlet of the cooling water.

Figure 2:
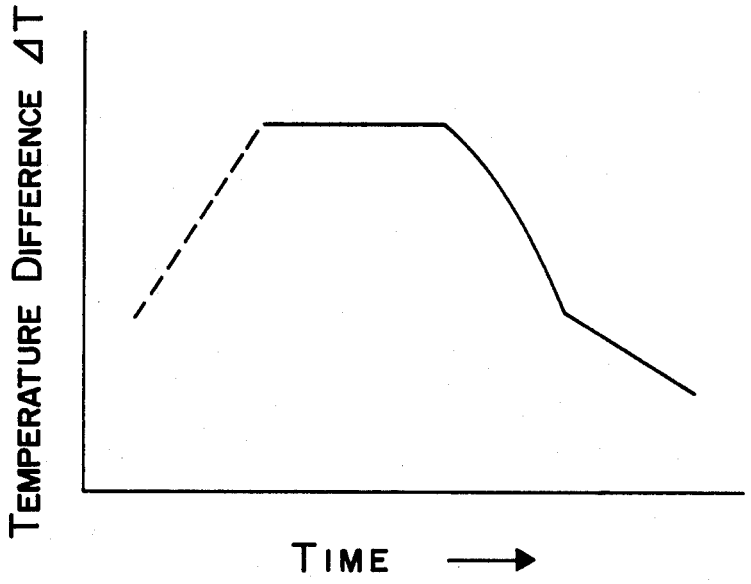
FIG. 2 is a schematic graph showing change of the temperature difference at the inlet and the outlet of the cooling water for a shooter of alloying elements depending on proceeding of refining.

FIG. 1 shows the detail. Oxygen gas and argon gas are blown into the molten steel 2 in the refining vessel 1 through the tuyere 11, and at the same time, oxygen gas is blown down from lance 3. The exhaust gas is transferred through hood 4 to a device (not illustrated) for dust-collecting and gas-treating. The alloying elements are added through shooter 5. To protect the shooter against the heat of the exhaust gas, the shooter has a jacket in which the cooling water is circulated. As the time passes during the refining, the difference in temperatures of the cooling water at inlet 51 and outlet 52 ($T_2-T_1$) changes as shown in FIG. 2.

The relation between the temperature difference and the carbon content in the molten steel may be, based on the fact that the temperature difference $\Delta T$ is a function of the decarburization rate and composition of the atmosphere.

$$\Delta T = f(dC/d\theta,\ CO_2/CO)$$

expressed by the equation:

$$C_p\omega\Delta T = K\left\{ W\frac{\Delta C}{100}(\Delta Hco + \alpha\Delta Hco_2)\right\} \quad (1)$$

in which, $C_p$: specific heat of water (Kcal/kg. °C.)

$\omega$: quantity of the cooling water (kg/min.)

W: weight of the molten steel (kg)

$\Delta C$: rate of decarburization (%/min.)

$\Delta Hco$, $\Delta Hco_2$:

heat generated by reaction $C \rightarrow CO$ and $CO \rightarrow CO_2$ (K cal/kg.°C.)

$\alpha$: conversion rate of $CO \rightarrow CO_2$

K: coefficient of heat-transfer to the cooling water.

Now, the later half of decarburization step is considered as an example. Generally, in the later half of the decarburization, the relation $dC/d\theta = \beta C$ (carbon diffusion-rate determining) is established, and therefore, the above noted formula(1) may be changed to:

$$C = \frac{C_p \cdot W}{\beta K \cdot \frac{W}{100}(\Delta Hco + \alpha\Delta Hco_2)} \cdot \Delta t \quad (2)$$

Figure 3:
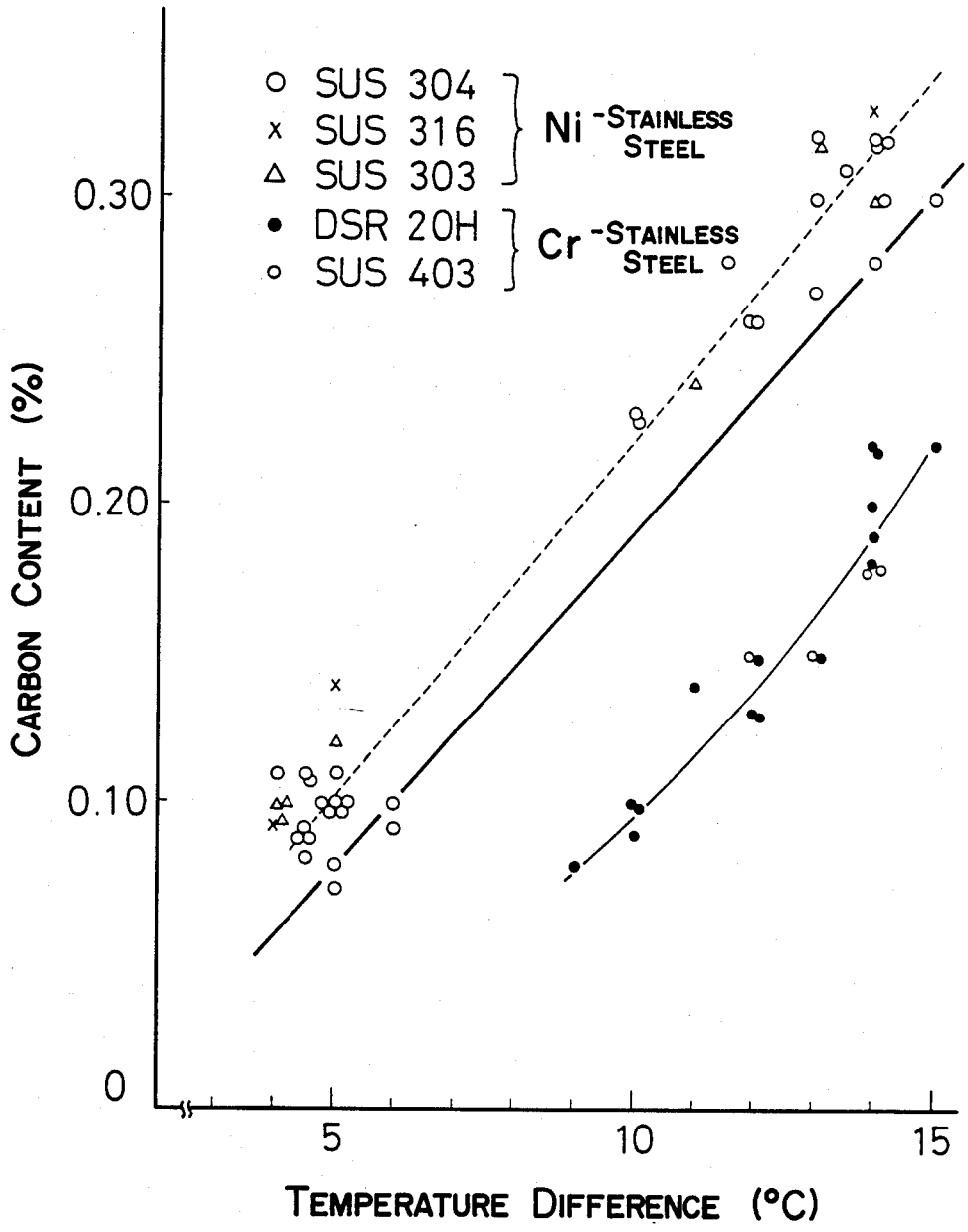
FIG. 3 is a graph showing relation between the temperature difference of the cooling water and the carbon content in the molten steel in the refining process using the apparatus shown in FIG. 1.

In fact, we investigated the relation between the cooling water temperature difference T and the carbon content(%) in the molten steel at refining of various stainless steels. As a result, the observed date proved very good concordance with the line (two straight lines) deduced by the above theory as shown in FIG. 3.

Thus, it is possible to determine the carbon content in the molten steel with considerable accuracy by observing the temperature difference of the cooling water.

Temperature control of the molten steel at the refining will now be discussed.

The heat balance at the refining operation is: (heat generated by oxidation of C)+(heat generated by oxidation of other substance)=(heat for increasing molten steel temperature)+(heat loss)

Now, the quantities of oxidation of carbon and the other substances during a period of time "t" are expressed with "$\Delta C$" and "$\Delta M$", respectively, molten steel heat increase with "$\Delta T$", and heat loss with "Q", the following equation is established:

$$\alpha C \cdot \frac{\Delta C}{100} \cdot W \cdot H_C + \alpha_M \frac{M}{100} \cdot W \cdot H_M = Q \cdot t + C_P \cdot \Delta T \quad (3)$$

$$\Delta M = \frac{v \cdot t - \alpha_C \cdot \frac{\Delta C}{100} \cdot W}{\alpha_M \cdot \frac{W}{100}} \quad (4)$$

wherein, $\alpha_C, \alpha_M$: quantity of $O_2$ consumed by oxidation of 1 kg of carbon or other substances $H_C$, $H_M$: heat generated by oxidation of 1 kg of carbon or other substances V: quantity of $O_2$ W: quantity of molten steel $C_p$: specific heat From equations (3) and (4), the following equation is derived:

$$T = \frac{\frac{\alpha C}{100}(H_C - H_M)}{C_P}\Delta C + \frac{H_M \cdot v - Q}{C_P} \cdot \frac{t}{W} \quad (5)$$

Since ΔC in equation (5) is, as noted above, a function of the temperature difference of the cooling water, it is possible to determine the temperature of the molten steel on the basis of the temperature difference of the cooling water, and therefore, it will be understood that the temperature of the molten steel can be controled utilizing the temperature difference.

In view of the value of coefficients in equation (5), it is considered that three of them, $(H_C - H_M)$, $H_M$ and t/W, give significant influence on ΔT. Out of them, $(H_C - H_M)$ and $H_M$ are coefficients depending on reactivity between carbon and oxygen. Taking into account that the carburization rate is lower at a lower temperature, it is considered that the temperature increase of the molten steel depends on the initiation temperature of refining, and that more increase is obserbed in case of a lower initiation temperature.

With respect to the temperature increase of the molten steel, the following relation is considered:

$\Delta T = K_1$ (temperature of cooling water) $+ K_2$ because the amount of oxidation of carbon, ΔC is a function of the temperature difference of the cooling water. (Because $H_C < H_M$, $K_1$ is a negative value. $K_2$ is a positive value.) In other words, the temperature increase of the molten steel will be expressed by a straight line declining at right hand in regard to the temperature difference of the cooling water.

Figure 4:
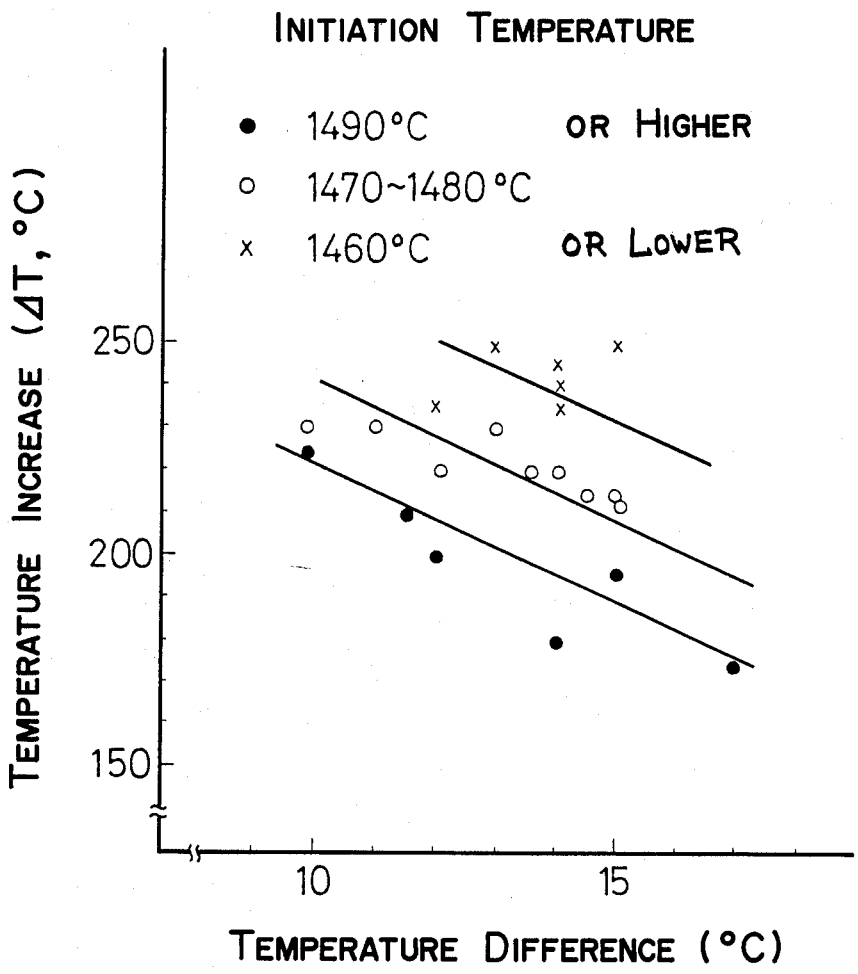
FIG. 4 is a graph showing the relation between the temperature difference of the cooling water and the temperature increase of the molten steel at the first stage of refining at various initial temperatures of refining.

The above presumption was found to be right by experiments. Survey of the relation between the temperature difference of the cooling water and the temperature increase of the molten steel at the end of the first step of refining SUS 304 steel gave the results shown in FIG. 4. From the graph of this Figure, extent of temperature increase of the molten steel can be determined using the temperature difference of the cooling water as a parameter, and therefore, it is possible to perceive and avoid the abnormal temperature increase. In addition, it was presumed that, in case of a higher silicon content at the initial stage of refining, the temperature increase will be larger, because silicon is oxidized preferentially to carbon while oxygen is blown. This was found to be also right.

As explained above, it is possible to grasp the change of the amount of heat taken away by the exhaust gas in a unit time utilizing the temperature difference of the cooling water, and to determine the carbon content in the molten steel and the rate of decarburization. Thus, it is now possible to control the flow rate and the composition of the gas blown into the vessel for refining in response to decrease of the decarburization rate. As known from the above noted "trapezoid model", in the area of low carbon content in the molten steel of 0.3% or less, the decarburization rate decreases in linear proportion to the decrease of the carbon content. It is advisable to decrease amount of the blown oxygen in conformity of the decreased decarburization rate to avoid, e.g., useless oxidation of chromium.

Figure 5:
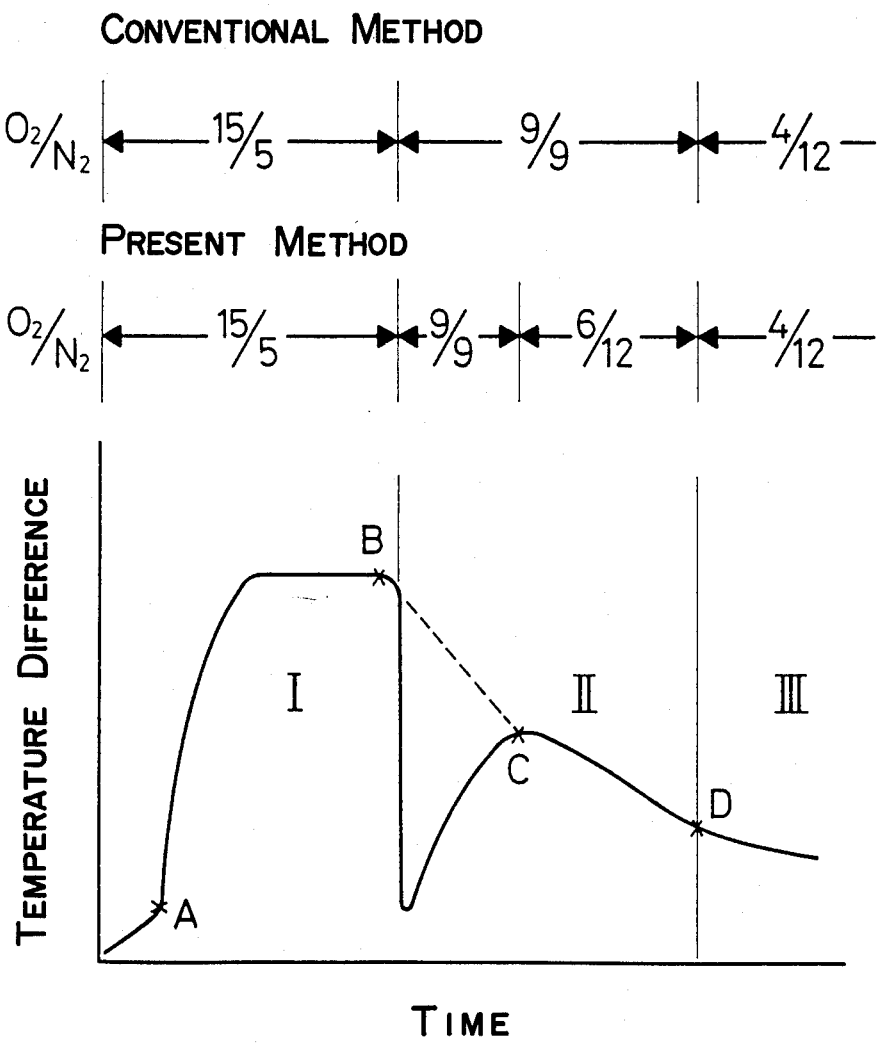
FIG. 5 shows change of the temperature difference of cooling water and operation pattern of the blowing gases in refing a Ni-based stainless steel in comparison with a conventional method.

As one example of such an operation, FIG. 5 shows alteration of composition of $O_2/N_2$ gas in refining of a Ni-based stainless steel based on the temperature difference of the cooling water.

At the first stage (Area I) of the operation in FIG. 5, the temperature difference begins to gradually increase when the refining begins, suddenly increases at the terminal stage of de-siliconization (Point A, the counter blow begins here), and becomes constant. When the temperature difference is found to decrease (Point B), the gas composition and the flow rate are changed and the blowing is continued. The sudden decline and incline of the curve are caused by reclining of the furnace for interruption of the blowing and, by resulting temporary cooling of the alloying elements-shooter.

If the temporary cooling does not occur, the temperature difference would progress as shown with the broken line.

The maximum point (Point C) of the temperature difference curve at the second stage (Area II) is also a point of turning, and therefore, the gas composition is further changed at this point to contain less oxygen.

After the next turning point (Point D), in Area III, oxidation of chromium begins to occur. The gas composition is further changed to contain the least amount of oxygen, and the flow rate is also decreased.

Comparison of the results of the above described operation pattern with the conventional operation pattern, it is found that the decarburization rate is the same level of 0.023 (% per minute) in both the paterns, and that the present method provides the following benefit of unit requirements:

| | Conventional Method | Present Method |
|---|---|---|
| Gas consumption ($Nm^3/t$) | | |
| $O_2$ | 4.0 | 3.4 |
| $N_2$ | 4.0 | 4.7 |
| $O_2$ consumed by oxidation of metals ($Nm^3/t$) | 7.4 | 6.6 |

In the conventional method, it is necessary to take samples and measure the temperature, at 4 points of time, namely, (1) first stage/second stage, (2) second stage/third stage, (3) third stage/Cr-reducing stage, and (4) finishing point. According to the present method, it is not necessary to take samples and measure the temperature at three points of time (1) to (3) noted above. As a result, the period for one operation cycle, which has been 70 minutes in averge can be at least 5 minutes shortened.

Figure 6:
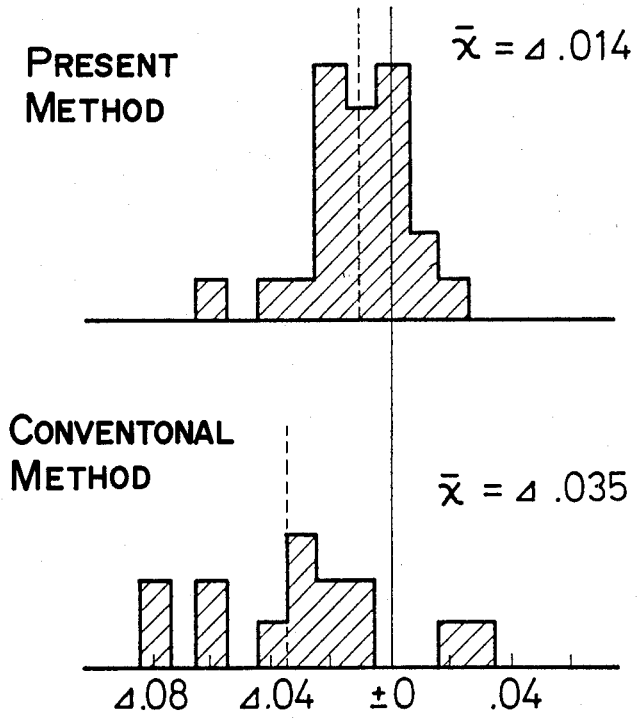
FIG. 6 is a histogram showing fluctuation of the carbon content in refining DSR20H steel adccording to the present method in comparison with the conventional method.
Figure 7:
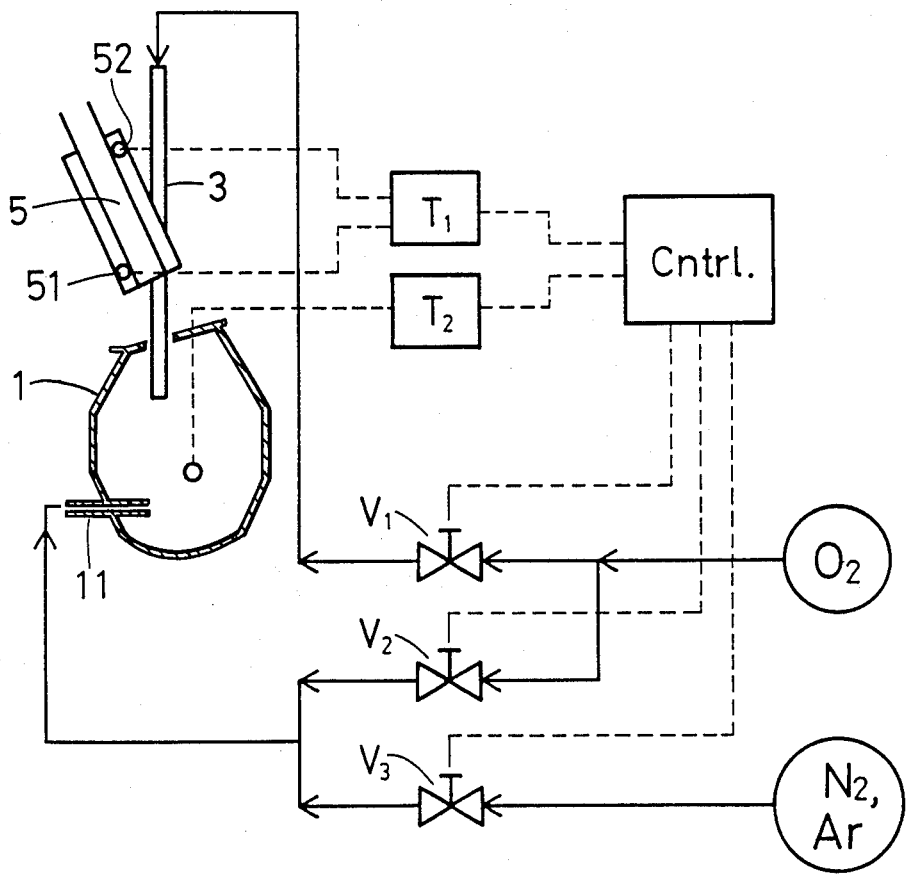
FIG. 7 is a schematic diagram showing the essential elements of the present apparatus.

Favorable effect of the present method of refining on the quality of product will be seen from FIG. 6. In refining DSR 20H steels, fluctuation of the practical carbon content around the target value, 0.40%, ranges $\bar{x}=0.035$ in the conventional method, whereas in the present method, it is reduced to $\bar{x}=0.014$.

As Further merit of the present method of refining, it should be noted that less damage is caused to the lining refractories of the reaction vessel due to prevention of the abnormal temperature increase, and that the vessel can be used many more times. According to our experience, it is easy to prolong the vessel life to about twofold.

The present method of refining has been explained above on the typical embodiment which uses the difference between the temperatures at the inlet and the outlet of the cooling water for alloying element shooter. As far as the idea of measuring the amount of heat taken away in a unit time by the exhaust gas is used according to the method of the present invention, the same merit as that of the typical embodiment can be obtained.

In summary, the present invention enables production of steels with highly controlled carbon contents, and excludes necessity of redoing the gas blowing. Also, unit requirements, particularly the gas consumption, are improved, and unit yields of the metallic materials are improved. Further, the cycle time of the operation is shortened to decrease steps of the procedure, and the life of the vessel for refinig is lengthened.

As noted, the present invention includes the apparatus for practicing the above described method of refining.

Figure 8:
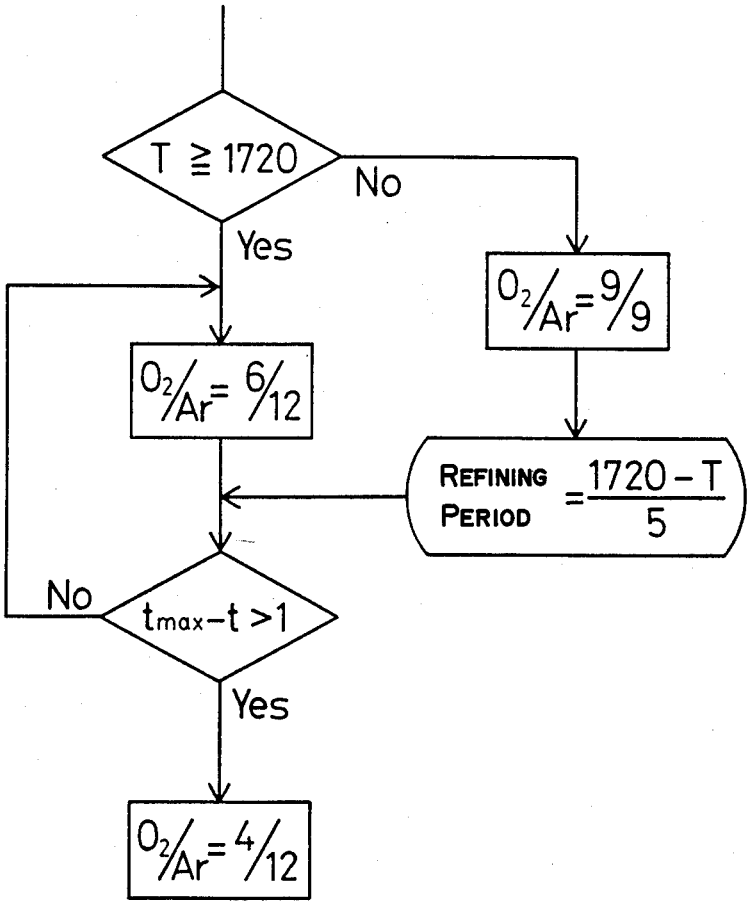
FIG. 8 is a flow diagram showing the procedure of adjusting the gas flow rates in the refining of steel using the apparatus of FIG. 7.

The apparatus of the present invention for refining steel comprises, as seen in FIG. 1 mentioned above, a vessel 1 having a tuyere 11, an exhaust gas draft hood (which is also a dust collector) 4 on the vessel, an alloying element shooter 5 which is water-cooled with a jacket in the hood, lance 3 for blowing oxygen gas, pipe lines for the oxygen gas from oxygen gas sourse ($O_2$) to the tuyere 11 and the lance 3 by way of control valves $V_1$ and $V_2$, a pipe line from inert gas source ($N_2$, Ar) to the tuyere 11 by way of control valve $V_3$, means for measuring the temperature difference $T_1$ at the inlet 51 and the outlet 52 of the cooling water flowing through the jacket, means for measuring temperature of the molten steel $T_2$, and means for controlling (Cntrl.) which receives signals from the means $T_1$ and $T_2$ to calculate suitable flow rates of the gases in accordance with a predetermined formula, and sending instructions for adjusting valves $V_1$, $V_2$ and $V_3$. As understood from the above explanation, the apparatus is to catch the turning point of the temperature difference of the cooling water, and thereby to control the gases blown for the refining. An example of operation of this apparatus under the procedure pattern shown in FIG. 5 is now illustrated. As shown in FIG. 8, in case where the highest temperature of refining is set to be 1720° C., temperature of the molten steel is measured and, until it reaches 1720° C., the ratio of refining gases is kept constant at $O_2/Ar=9/9$. When the temperature of the molten steel reaches 1720° C., the ratio is changed to $O_2/Ar=6/12$, and the refining is continued. During the refining, the temperature difference $t_1$ of the cooling water is measured and, when it is detected that the temperature difference decreased to be at least 1° C. lower than the maximum temperature difference to maximum, the ratio of the gases is changed to be $O_2/Ar=4/12$.

Thus, the refining of steel is continued at the optimum conditions under automatic control by a computor.

We claim:

1. A method of adjusting the carbon content of molten steel to a desired carbon content, which comprises:

determining the carbon content in the molten steel by measuring a change of the heat taken away per unit time in cooling water heat exchanged with exhaust gas removed from the molten metal, according to the following formula:

$$C = \frac{Cp \cdot W}{\beta K \frac{W}{100} (\Delta Hco + \alpha \Delta Hco_2)} \cdot \Delta t$$

wherein C is the carbon content of the molten steel, Cp is specific heat of water (K cal/kg. °C.), W is weight of molten steel (kg), $\beta$ is a carbon diffusion-rate constant, K is a coefficient of heat transfer for the cooling water, $\Delta Hco$ is heat generated by reaction $C \rightarrow CO$ (K cal/kg. °C.), $\Delta Hco_2$ is heat generated by reaction $CO \rightarrow CO_2$ (Kcal/kg. °C.), $\alpha$ is conversion rate of $CO \rightarrow CO_2$, and $\Delta t$ is the difference in temperature of the cooling water after and before being heat exchanged; and blowing oxygen into the molten steel in an amount to yield the desired carbon content.

2. A method of adjusting the carbon content in molten steel according to claim 1, wherein the exhaust gas passes through an exhaust hood and the cooling water is circulated through and heat-exchanged in the exhaust hood.

3. A method of adjusting the carbon content in molten steel according to claim 2, wherein a shooter for addition of alloying elements is positioned in the exhaust hood and the cooling water is circulated through and heat-exchanged in the shooter.

4. A method of adjusting the carbon content in molten steel according to claim 1, wherein oxygen gas and an inert gas are blown into the molten steel and, during at least a portion of a period of the blowing, at least one of the oxygen gas and the inert gas is blown down to the surface of the molten steel.

5. A method of adjusting the carbon content in molten steel according to claim 1, wherein the oxygen gas and an inert gas are blown into the molten steel and, based on the determined carbon content, flow rates and mixing ratios of the gases are adjusted to yield the desired carbon content.

6. A method of refining steel in which oxygen gas is blown into molten steel in a vessel to decarburize the steel and to adjust the carbon content of the steel contained therein to a desired carbon content based upon a change of heat taken away per unit time, which comprises:

providing the molten steel in the vessel, blowing the oxygen gas onto the molten steel, removing exhaust gas from the vessel, heat-exchanging cooling water with the exhaust gas, and measuring the difference in temperature of cooling water after and before the heat-exchanging, determining the carbon content in the molten steel by measuring the change of heat taken away per unit time in the cooling water heat exchanged with the exhaust gas according to the following formula:

$$C = \frac{Cp \cdot W}{\beta K \frac{W}{100} (\Delta Hco + \alpha \Delta Hco_2)} \cdot \Delta t$$

wherein C is the carbon content of the molten steel, Cp is specific heat of water (K cal/kg. °C.), W is weight of molten steel (kg), $\beta$ is a carbon diffusion-rate constant, K is a coefficient of heat transfer for the cooling water, $\Delta Hco$ is heat generated by reaction $C \rightarrow CO$ (K cal/kg. °C.), $\Delta Hco_2$ is heat generated by reaction $CO \rightarrow CO_2$ (K cal/kg. °C.), $\alpha$ is conversion rate of $CO \rightarrow CO_2$, and $\Delta t$ is the difference in temperature of the cooling water after and before being heat-exchanged; and blowing oxygen into the molten steel in the vessel in an amount to yield the desired carbon content.

7. A method of refining steel according to claim 6, wherein the exhaust gas passes through an exhaust hood and the cooling water circulated through and heat exchanged in the exhaust hood.

8. A method of refining steel according to claim 7, wherein a shooter for additional alloying elements is positioned in the exhaust hood and the cooling water circulated through and heat exchanged in the shooter.

9. A method of refining steel according to claim 6, wherein oxygen gas and an inert gas are blown into the molten steel and, during at least a part of a period of the blowing, at least one of the oxygen and the inert gas is blown down to the surface of the molten steel.

10. A method of refining steel according to claim 6, wherein the oxygen gas and an inert gas are blown into the molten steel and, based on the determined carbon content, flow rates and mixing ratio of the gases are adjusted to yield the desired carbon content.

* * * * *